United States Patent [19]

Corghi

[11] Patent Number: 4,706,458

[45] Date of Patent: Nov. 17, 1987

[54] HYDRAULIC SYSTEM FOR CONTROLLING MOTOR VEHICLE LIFTS IN GENERAL

[75] Inventor: Remo Corghi, Correggio Emilia, Italy

[73] Assignee: Corghi Elettromeccanica S.p.A., Correggio Emilia, Italy

[21] Appl. No.: 868,244

[22] Filed: May 29, 1986

[51] Int. Cl.[4] ..... F15B 7/00

[52] U.S. Cl. ..... 60/546; 60/581; 91/171; 91/189 R; 91/515

[58] Field of Search ..... 60/546, 581; 91/171, 91/515, 189 R

[56] References Cited

U.S. PATENT DOCUMENTS 3,769,881 11/1973 Aoki ..... 91/171
4,161,229 7/1979 Mifsud ..... 91/171
4,192,222 3/1980 Dits ..... 91/171
4,241,581 12/1980 Chace ..... 60/546

*Primary Examiner*—Abraham Hershkovitz
*Attorney, Agent, or Firm*—Brisebois & Kruger

[57] ABSTRACT

A hydraulic system for lifts provided with two independently supported parallel platforms comprises at least two cylinder-piston units (80, 81) for raising the platforms, a metering device (7) for feeding identical quantities of fluid to said two units, and a balancing device (74, 75) operated by means (31, 32) for measuring the height difference between the platforms and arranged to feed a quantity of supplementary fluid to that cylinder-piston unit (80) or (81) operating the lower platform by withdrawing it from that cylinder-piston unit (81) or (80) operating the higher platform.

5 Claims, 2 Drawing Figures

HYDRAULIC SYSTEM FOR CONTROLLING MOTOR VEHICLE LIFTS IN GENERAL

This invention relates to a hydraulic system for controlling those lifts usually used in vehicle workshops, of the type provided with two parallel platforms supported independently of each other by mechanical members.

Lifts are known comprising a flat base frame, the longitudinal members of which form part of two articulated quadrilaterals having the sides opposite the longitudinal members in the form of two parallel platforms for lifting motor vehicles. In such lifts, there is the problem of simultaneously raising and lowering the two platforms in such a manner that they are always perfectly coplanar. In seeking to solve said problem, use has been made up to the present time of a suitable torsion bar disposed transversely to connect together two corresponding sides of the two quadrilaterals, but this known system has not given the desired results in that the two platforms very often lie at two considerably different heights, with differences of the order of several centimeters, because of the elastic deformation of the bar. Furthermore, the presence of said torsion bar creates considerable overall size problems as it does not enable the base frame to be constructed in two separate parts.

The present patent provides and protects a system able to obviate the aforesaid within the framework of a simple and rational construction. In it, the two articulated quadrilaterals which support the platforms are operated, independently of each other, by separate cylinder-piston units operated by a common hydraulic power unit by way of a metering unit of known type, consisting of two identical cylinder-piston units which are aligned and coaxial, their pistons being mechanically connected to each other so that they move together. Two corresponding chambers, or thrust chambers, are fed with pressurised fluid so that the fluid causes the pistons to move in the same direction, whereas the two opposing chambers, or drive chambers, feed identical quantities of fluid, when the pistons move together, to the hydraulic means which deform the two articulated quadrilaterals.

This type of construction, which should theoretically ensure identical deformation of the two quadrilaterals, is difficult to implement in practice because of fluid leakages.

According to the invention, the hydraulic system is supplemented by balancing means which allow instantaneous recovery of said leakages when they exceed a predetermined threshold value.

This is attained according to the invention by providing a hydraulic balancing circuit able to feed quantities of fluid from the cylinder-piston units operating one quadrilateral to the cylinder-piston units operating the other quadrilateral. Said hydraulic balancing circuit is controlled by measurement members which measure the heights of the two platforms and produce an output signal proportional to their height difference. According to the invention, said measurement can for example be made by transducer means arranged to measure the angle between adjacent sides of the articulated quadrilaterals, said means being connected to a comparator and to an electrical circuit for controlling said hydraulic balancing circuit.

This latter in practice is an auxiliary metering device identical to the aforesaid metering device, to which it is connected in an inverted position, ie in a position such that when the two mutually connected pistons move, instead of feeding identical quantities of fuel to the two corresponding chambers of the main metering device they feed to one of said chambers of quantity of fluid which they have withdrawn from the other, and vice versa. The operation of said auxiliary metering device is controlled by the comparator signals which, by means of a solenoid valve, cause the two opposing chambers of the device which do not communicate with the main metering device to be connected respectively to a feed pipe or to a discharge pipe.

The characteristics and constructional merits of the invention together with the arrangement of the usual safety and control means will be apparent from the detailed description given hereinafter with reference to the accompanying drawings which illustrate one embodiment thereof by way of example only.

Figure 1:
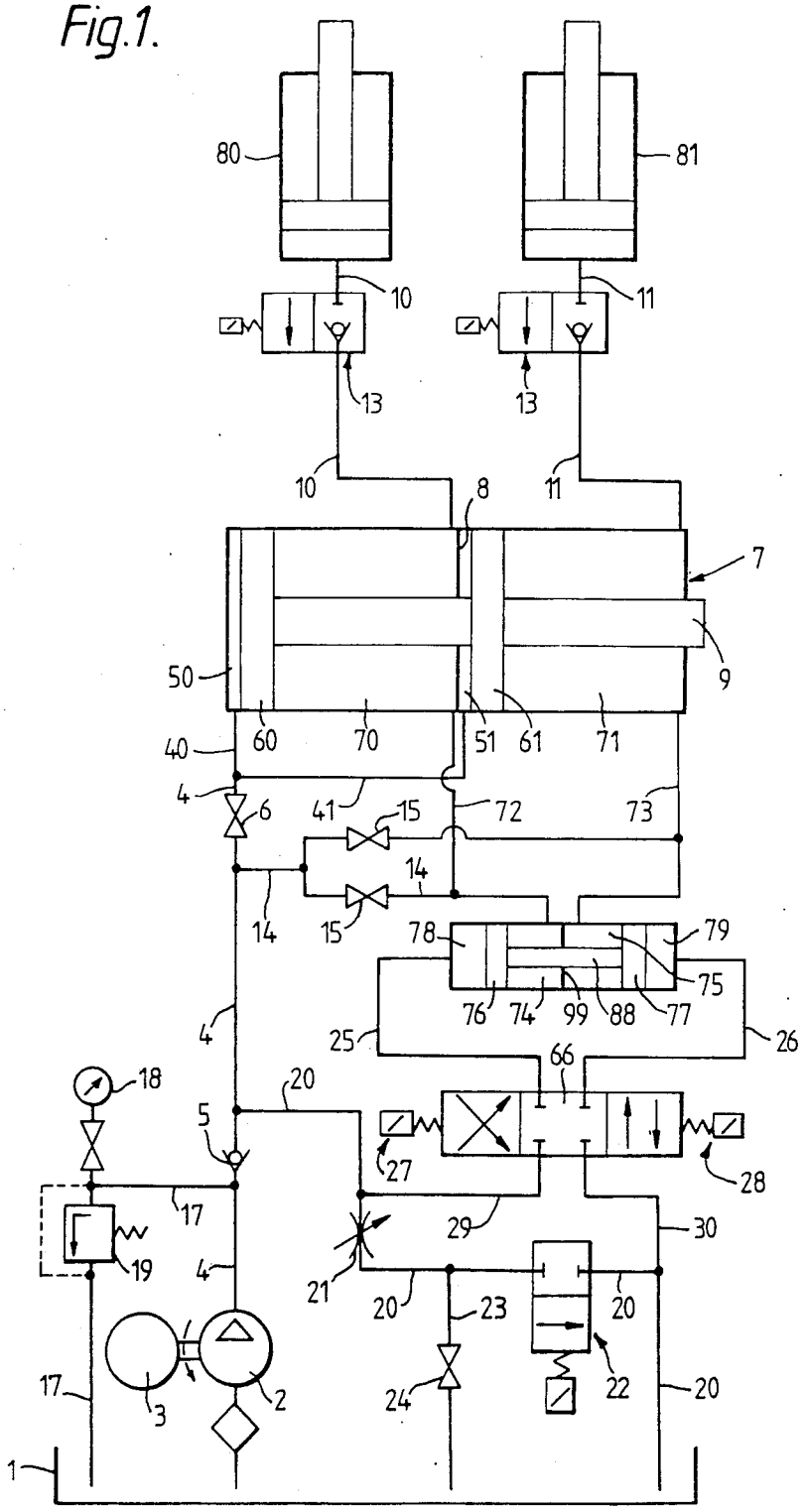
FIG. 1 is a hydraulic schematic diagram of the invention.

FIG. 1 shows a vessel 1 for containing the hydraulic fluid which feeds a pump 2 driven by an electric motor 3 and provided with a delivery pipe 4 fitted with a non-return valve 5 and a valve 6 for initially filling the system in combination with the valves 15 provided in the pipes 14. Downstream of the valve 6 the pipe 4 branches into two pipes 40, 41 which open into the thrust chambers 50, 51 of a metering device 7 comprising a cylindrical compartment separated into two halves by a partition 8. On each side of the partition there are provided two pistons 60, 61 which define two thrust chambers 50, 51 and two service chambers 70, 71, and which are connected together by a coaxial rod 9 which passes through said partition 8 in a sealed manner. At least two single-acting cylinder-piston units 80, 81 are connected in parallel to said chambers 70, 71 by way of respective pipes 10 and 11, each to control the deformation of an articulated quadrilateral carrying one platform of a motor vehicle lift of the type described in the introduction.

In each pipe 10 and 11 there is provided a normal safety solenoid valve 13, which if abnormal situations such as a fractured pipe should occur is able to lock the lift platforms in the position in which they lie at that moment. Said solenoid valves 13 are directly incorporated or formed in the rear end of the respective cylinder-piston units 80 and 81 in the normal manner.

From the upstream side of the valve 5 there branches a by-pass 17 to which a pressure gauge 18 and a pressure relief valve 19 are connected, whereas from the downstream side of the valve 5 there branches a pipe 20 connected to a flow limiting valve 21 and to a two-position, open-closed solenoid valve 22, both the pipes 17, 20 opening into the vessel 1. A manual discharge valve 24 is connected to a branch 23 parallel to the solenoid valve 22.

According to the invention, two pipes 72, 73 connect the chambers 70, 71 of the metering device to the chambers 74, 75 of the auxiliary metering device, these latter chambers being defined by two pistons 76, 77 connected together by a rod 88 which passes in a sealed manner through the separating partition 99. The other two chambers 78, 79 define by the pistons 76 and 77 are connected by two pipes 25, 26 to a four-way slide valve 66 to which there are also connected a feed pipe 29 branching from the pipe 20 upstream of the flow limiting valve 21, and a pipe 30 which discharges directly into the vessel 1. The movements of the slide valve 66 are controlled in both directions by two solenoid valves 27 and 28, which move it from a central rest position to a position in which the pipe 25 is connected to 30 and the pipe 26 is connected to 29, and, respectively, to a position in which the pipe 25 is connected to 29, and the pipe 26 is connected to 30.

Figure 2:
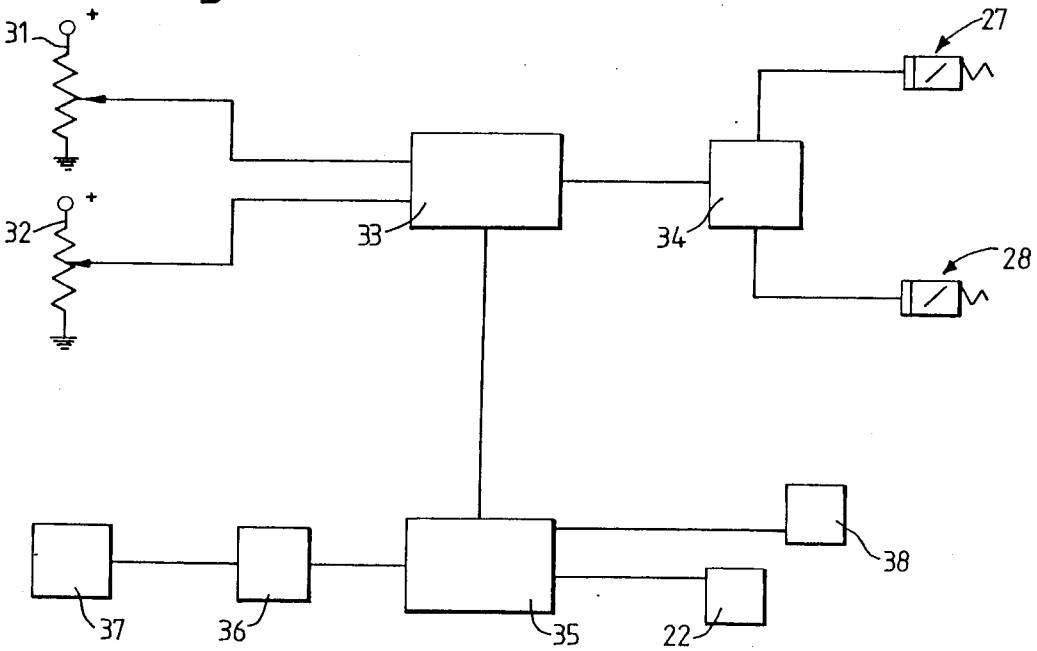
FIG. 2 is a block diagram of the circuit for measuring the platfrom heights and for controlling the operation of the system of FIG. 1.

Said two solenoid valves 27, 28 are controlled by the control circuit, the block diagram of which is shown in FIG. 2. Said circuit comprises two transducers 31, 32 for constant measurement of the height of the two platforms by measuring the angle between two adjacent sides of the two articulated quadrilaterals. The output signals from the transducers 31, 32 are received by a voltage comparator device 33 which compares said two signals and adds them together. If the difference between the two signals exceeds a threshold value corresponding to a height difference between the platforms of the order of one centimeter, said comparator device 33 feeds a suitable signal to a logic circuit 34 which energises one of the solenoid valves 27, 28, namely the solenoid valve 27 if the left hand platform is higher than the right hand platform, and the solenoid valve 28 in the opposite case.

Said control circuit for the solenoid valves 27, 28 can also form part of a more complicated general control circuit 35 to which there are connected to a circuit 36 for automatically monitoring the height of the platforms, a dial 37 for displaying the said height, a solenoid valve 22 for controlling the descent, and a remote switch 38 for the motor 3.

The invention operates as follows:

assuming that the left hand platform is higher than the right hand platform, the circuit 34 operates the valve 27, with the result that the pipe 29 is connected to the pipe 26 and the pressurised fluid acting in 79 urges the pistons 76 and 77 to the left, the excess fluid in 78 flowing through 25 and 30 to discharge. By virtue of the movement of the pistons 76 and 77, an equal quantity of fluid leaves 75 to raise the right hand platform and enters 74 to lower the left hand platform. When the platforms are coplanar the valve 27 is de-energised.

This occurs both during lifting, when the pressurised fluid acting in 79 originates from the pump 2, and during descent when said fluid originates from the chambers 50 and 51. As the chamber 78 is freely connected to discharge, whereas the pipe 29 is connected to discharge by way of the flow limiting valve 21, the pressure in 79 also exceeds that in 78 during discharge.

Should the right hand platform lie higher than the left hand platform, the solenoid valve 28 is operated and the cycle proceeds in the reverse direction.

It is apparent that the invention is not limited to that described and illustrated heretofore, but comprises all technical equivalents of the described means and their combinations, if implemented in accordance with the following claims.

I claim:

1. In a hydraulic system for controlling lifts which comprise two independent parallel platforms independently raised respectively by two cylinder-piston units (80, 81), and having at least one pump (2) and a metering device (7) comprised of two identical coaxial cylinders with two pistons (60, 61) slidable therein and which are rigidly connected together by a rod (9) and divide the two cylinders respectively into first and second driving chambers (50, 51) which receive the pressurised fluid from the pump, and first and second operating chambers (70, 71) which feed identical quantities of hydraulic fluid respectively to the two cylinder-piston units (80, 81), the improvement comprising, a balancing device comprised of two identical coaxial cylinders, two pistons (76, 77) respectively dividing the cylinders of the balancing device into a thrust chamber and a compensating chamber to form first and second thrust chambers (78, 79), and first and second compensating chambers (74, 75), a rod (88) rigidly connecting said pistons together for movement in unison so that the volume of either compensating chamber increases as the volume of the other compensating chamber decreases; conduit means (72) connecting said first compensating chamber (74) of the balancing device to said first operating chamber (70) of the metering device, conduit means (73) connecting said second compensating chamber (75) of the balancing device to the second operating chamber (71) of the metering device, valve means (66) moveable to a first position and to a second position, said valve means in said first position connecting said first thrust chamber (78) to a source of pressurised fluid, and said second thrust chamber (79) to a discharge pipe, to force a volume of fluid from said first compensating chamber (74) into the first operating chamber (70) and to receive an equal volume of fluid in said second compensating chamber (75) from the second operating chamber (71), said valve means in said second position connecting said second thrust chamber (79) to said source of pressurised fluid, and said first thrust chamber (78) to said discharge pipe to force a volume of fluid from said second compensating chamber (75) into the second operating chamber (71) and to receive an equal volume of fluid in said first compensating chamber (74) from the first operating chamber (70), and means for actuating said valve means (66) to said first and second positions in response to a pretermined sensed difference in height between the two platforms.

2. A system as claimed in claim 1, wherein said valve means (66) comprises a slide valve, and said means for actuating said valve means (66) comprises, two transducers (31, 32) for measuring and monitoring the position of the two platforms, two solenoids (27, 28) which actuate the valve means (66) to said first and second positions, and a comparator (33) for comparing signals from said transducers for energizing said solenoids in response to a compared difference of signals indicative of a predetermined difference in height of the platforms.

3. A system as claimed in claim 2, wherein said valve means comprises a slide valve moveable to said first and second positions from a third position in which said thrust chambers (78, 79) are blocked.

4. A system as claimed in claim 1, wherein said source of pressurised fluid is pressurized from the pump (2), during lifting of said platforms.

5. A system as claimed in claim 1, wherein said source of pressurised fluid is pressurized from the driving chambers of the metering deivce during descent of said platforms.

* * * * *